US005385093A

United States Patent [19]

Rogge et al.

[11] Patent Number: 5,385,093

[45] Date of Patent: Jan. 31, 1995

[54] INKING UNIT HAVING A CANTILEVERED INKING ROLLER, AS WELL AS A CANTILEVERED PLATE CYLINDER

[75] Inventors: Gunter Rogge, Lienen; Uwe Rogge, Lengerich, all of Germany

[73] Assignee: Windmoeller & Hoelscher, Lengerich/Westf., Germany

[21] Appl. No.: 76,897

[22] Filed: Jun. 15, 1993

[30] Foreign Application Priority Data

Jun. 15, 1992 [DE] Germany ..... 9208023[U]
Jun. 24, 1992 [DE] Germany ..... 9208449[U]

[51] Int. Cl.[6] ..... B41F 13/30; B41F 13/32

[52] U.S. Cl. ..... 101/247; 101/352

[58] Field of Search ..... 101/216, 219, 228, 329, 101/330, 247, 351, 352

[56] References Cited

U.S. PATENT DOCUMENTS 1,030,712 6/1912 Brett .
1,147,947 7/1915 Johnson .
3,457,854 7/1969 Marozzi ..... 101/330
4,224,871 9/1980 Hars et al. ..... 101/248

FOREIGN PATENT DOCUMENTS 0226554 6/1987 European Pat. Off. .
0393336 10/1990 European Pat. Off. .
1991539 8/1968 Germany .
3500319 7/1987 Germany .
3733375 4/1989 Germany .
3938405 5/1991 Germany .

*Primary Examiner*—J. Reed Fisher
*Attorney, Agent, or Firm*—Jacobson, Price, Holman & Stern

[57] ABSTRACT

An inking unit having a cantilevered inking roller and a cantilevered plate cylinder. The plate cylinder and the inking roller are mounted together and for horizontal displacement relative to each other. The plate cylinder and the inking roller are pivotally mounted both together as well as separately on pins arranged in the zone of the cantilever mounting.

8 Claims, 6 Drawing Sheets

INKING UNIT HAVING A CANTILEVERED INKING ROLLER, AS WELL AS A CANTILEVERED PLATE CYLINDER

FIELD OF THE INVENTION

The invention concerns an inking unit with cantilevered inking roller, i.e. the roller is mounted only at one end, and with a cantilevered plate cylinder, wherein the plate cylinder and the inking roller are mounted together and for horizontal displacement relative to each other.

PRIOR ART

In known inking units of printing units in flexographic printing presses, it has so far been customary to support the plate cylinder, as well as the inking roller at both ends, so as to obtain a proper uniform contact pressure over the whole length of the plate cylinder. However, the drawback of such inking units lies in the fact that on the one hand, they are of a very expensive design and, on the other hand, that when one is operating with sleeves, very elaborate precautions have to be taken to free the plate roller or the plate cylinder to allow a sleeve to be fitted.

OBJECT OF THE INVENTION

It is, therefore, the object of the present invention to develop the inking units of the printing mechanisms of flexographic printing presses in such a way that it becomes possible to mount both the inking roller and the plate cylinders at only one end and yet to ensure that, on the one hand, the plate cylinder is uniformly inked up by the inking roller and that, on the other hand, a uniform application of the ink from the plate cylinder to the web to be printed is ensured.

SUMMARY OF THE INVENTION

In accordance with the invention, this problem is solved, starting with a generic inking unit, in that the plate cylinder and the inking roller are pivotally mounted both together as well as separately, or journal pins arranged in the zone of the one-sided mounting.

In this arrangement, the plate cylinder may be cantilevered in a plate cylinder block mounted for displacement on a bracket, the plate cylinder block comprising a plate resting on the bracket plate with scope for displacement.

For displacing the plate cylinder there may be a lead screw which engages with its thread in the thread of a plate that is orientated perpendicularly to the plate of the plate cylinder block and is rigidly connected to that plate, as well as being mounted for rotation in a bearing housing connected to the bracket. By means of this lead screw spindle it is possible to set the plate cylinder, together with the inking roller, against the impression cylinder.

According to a further development of the invention, the inking roller can be cantilevered in an inking roller block mounted for displacement on the plate of the plate cylinder block. For the displacement of the inking roller, provision may be made for a lead screw which engages with its thread in the thread of the plate extending perpendicularly to the plate of the plate cylinder block, while its other end is mounted for rotation in a bearing on the inking roller block. Thus by rotating this lead screw, a relative displacement is obtained between the inking roller and the plate cylinder.

The invention is developed further, particularly advantageously, in that the inking roller block is mounted for pivoting on a journal pin relative to the plate cylinder block by means of a lead screw, in that the lead screw engages at the end of a lever whose other end is mounted for rotation in the inking roller block and the lever has in its centre zone a guide pin projecting into a groove in the plate of the plate cylinder block. Because of this, it is possible, by rotating the lead screw, for the inking roller which is inked up at the start of printing to be set against the plate cylinder in such a way that the ink is uniformly transferred to the plate cylinder over the whole length.

Finally, a further advantageous development of the invention is obtained in that the plate cylinder block is mounted for pivoting round a journal pin by means of a lead screw spindle, in that the lead screw engages at one end of the lever whose other end is mounted for rotation in the plate of the plate cylinder block, and in which arrangement the lever has in its centre zone a pin which projects into the longitudinal groove of the bracket plate. Because of this, it is possible to set the plate cylinder against the impression cylinder in such a way that a uniform contact pressure is obtained.

In an inking unit according to the invention, with a plate cylinder mounted in a cantilever mode and cooperating with an impression cylinder, vibrations may be excited, in particular because the plate cylinder receives an impact during each passing of a stereotype (master) over the impression cylinder or the inking roller. If the vibrations are excited the resonant frequency, these may increase in amplitude to a considerable extent. If the plate cylinder is subjected to vibrations during the printing operations, a clean uniform print is not ensured. To suppress these vibrations, or at least to damp them effectively, according to a main feature of the invention, a ring whose diameter corresponds to the diameter of the cylindrical envelope described by the stereotypes (masters) may be fitted on the free end zone of the plate cylinder. The plate cylinder with its stereotypes (masters) rolls over the web to be printed while the web is supported by the impression cylinder, and also over the inking roller, whereby in those zones where there is no stereotype gaps are formed between the plate cylinder and either the impression cylinder on the one hand or the inking roller on the other hand. These gaps cause or allow vibrations of the plate cylinder which impair the quality of the printing. By means of the ring fitted at one end on the plate cylinder, it is possible to ensure that the plate cylinder bears on the impression cylinder and the inking roller, or that it rolls off between the two, so that the plate cylinder is, as it were, also fixed at its free end between the impression cylinder and the inking roller. By means of this fitting, which is similar to a bearing arrangement, vibrations of the plate cylinder are effectively suppressed or damped.

Expediently the ring consists of an elastomeric material. As a suitable elastomeric material, there may be used for example, a synthetic material or rubber. The elasticity and quality of the rubber should be chosen in such a way that optimum running qualities are ensured.

The ring may be fitted on the free end of the plate cylinder without stereotypes (masters). If the stereotypes are provided on an exchangeable sleeve of the plate cylinder, the ring is fitted at the distance from the plate cylinder sleeve on a plate cylinder core which carries the sleeve.

On the inking roller, the ring expediently runs on an unlinked cylindrical end section.

The ring may, in a known way, be mounted on the end of the plate cylinder. For the mounting, provision may be made for an annular shoulder for example, onto which there is screwed a disk which tightens a mounting component of the ring.

The diameter of the ring should approximately correspond to the diameter of the cylindrical envelope described by the stereotypes. With a suitable elasticity of the ring, a slightly larger diameter may also be considered.

BRIEF DESCRIPTION OF THE DRAWINGS:

These and other objects and advantages of the invention will become more readily apparent from a reading of the following description of one example of the embodiment of the invention described in greater detail below with reference to the accompanying drawings. In the drawings.

DETAILED DESCRIPTION OF THE PREFERRED EMBODIMENT

Figure 1:
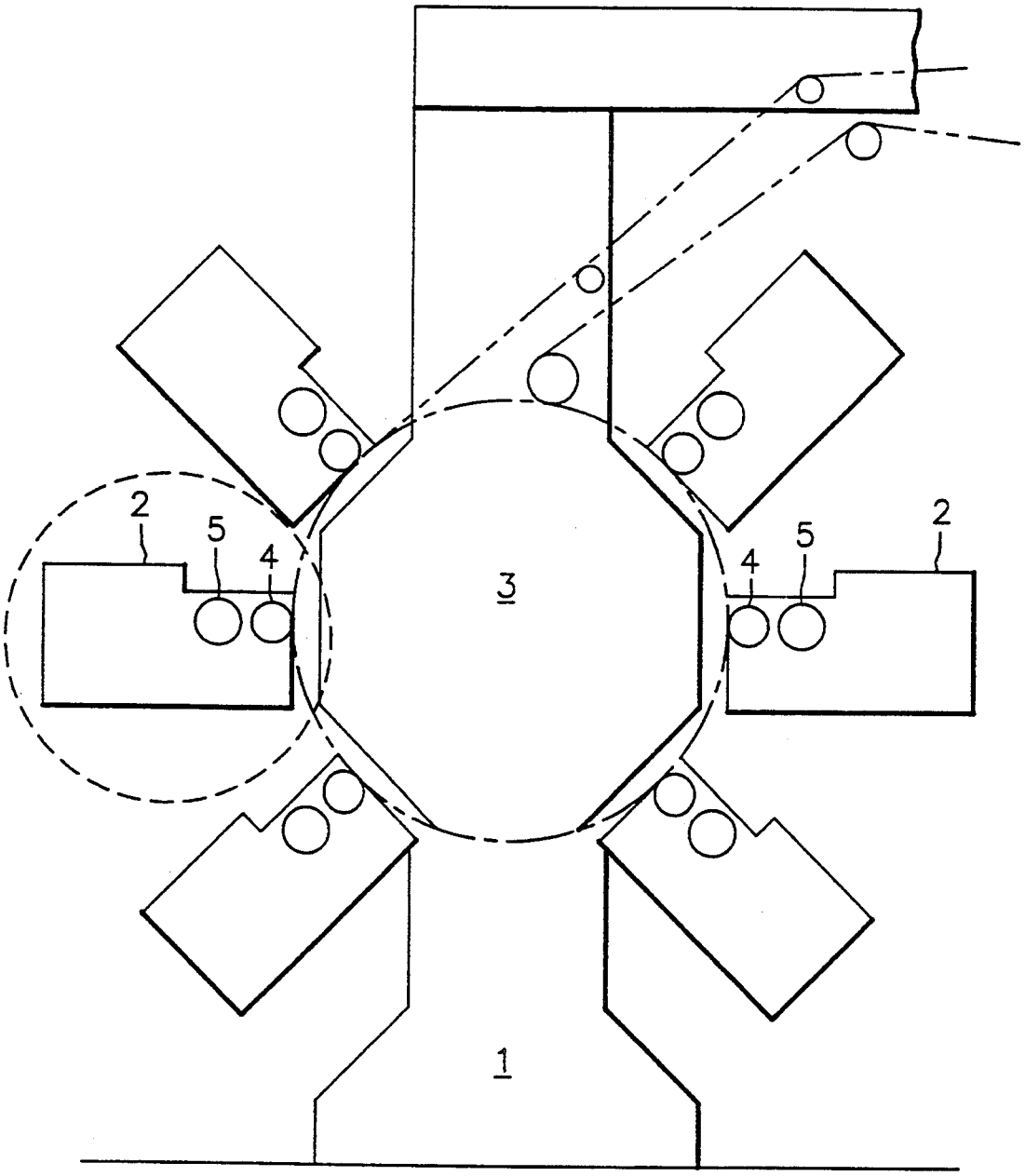
FIG. 1 is a side view of a flexographic printing press with several inking units and a common impression cylinder.
Figure 2:
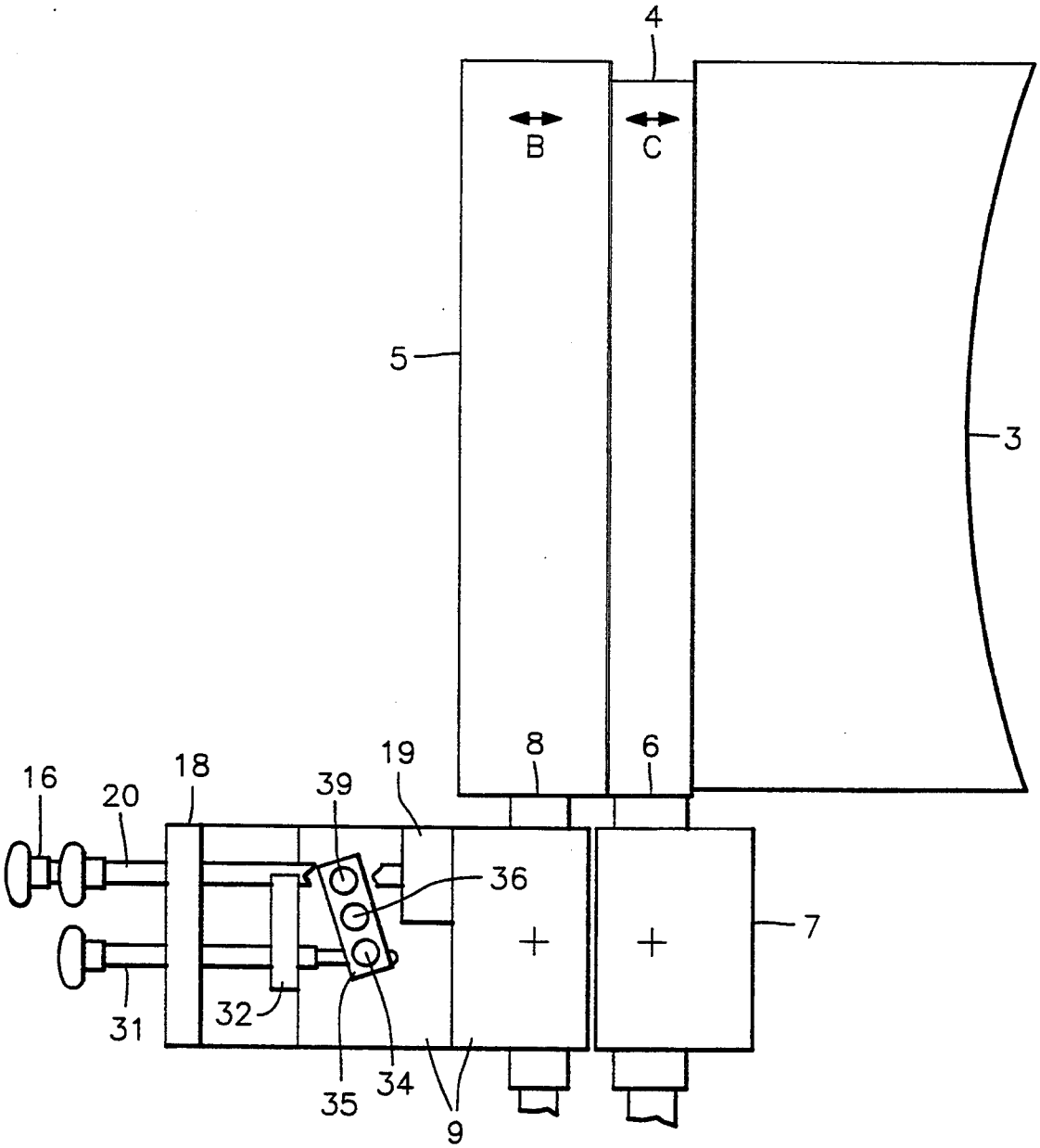
FIG. 2 is a top view of the part ringed with dashed lines in FIG. 1.
Figure 3:
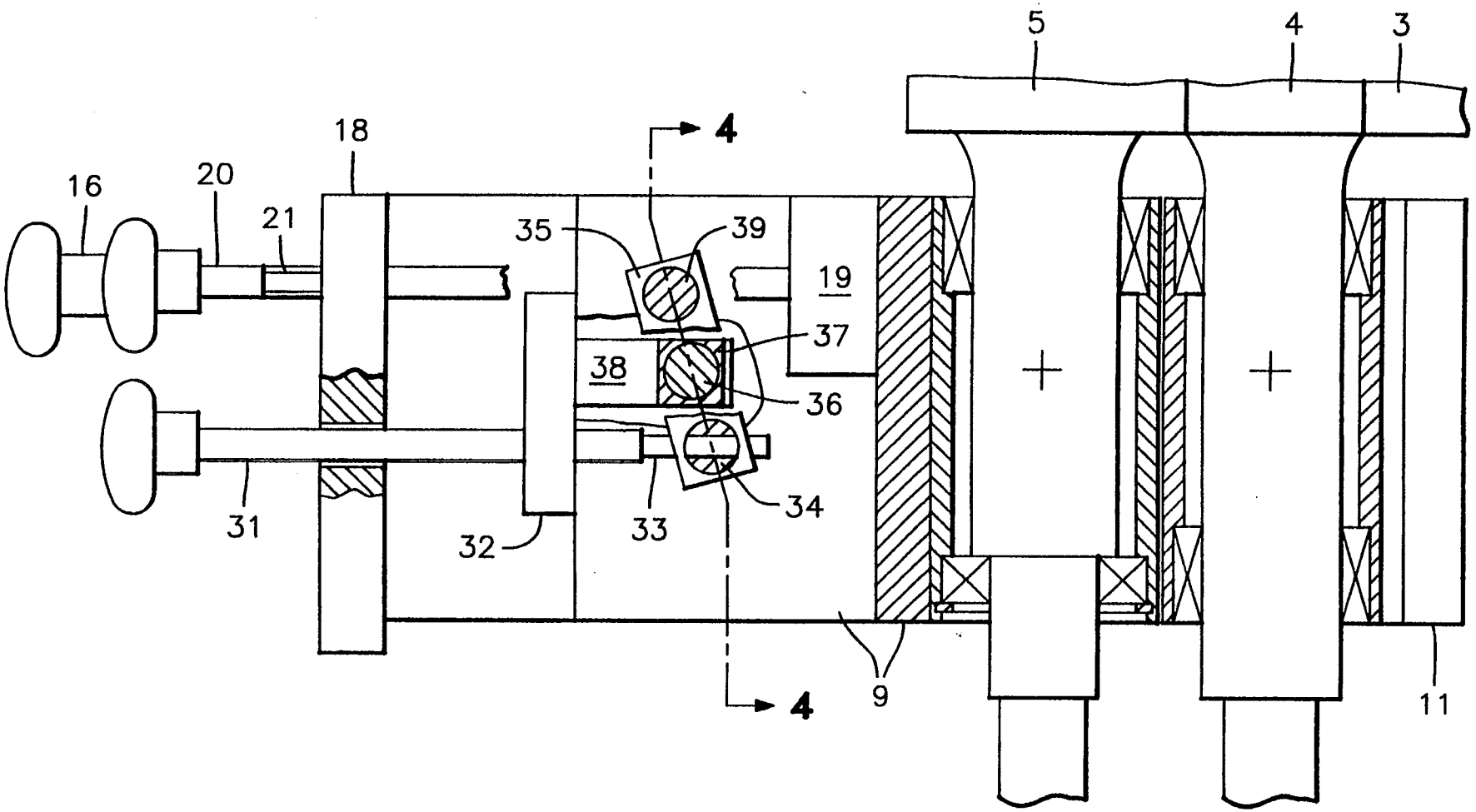
FIG. 3 is an enlarged representation of a portion of FIG. 2.
Figure 4:
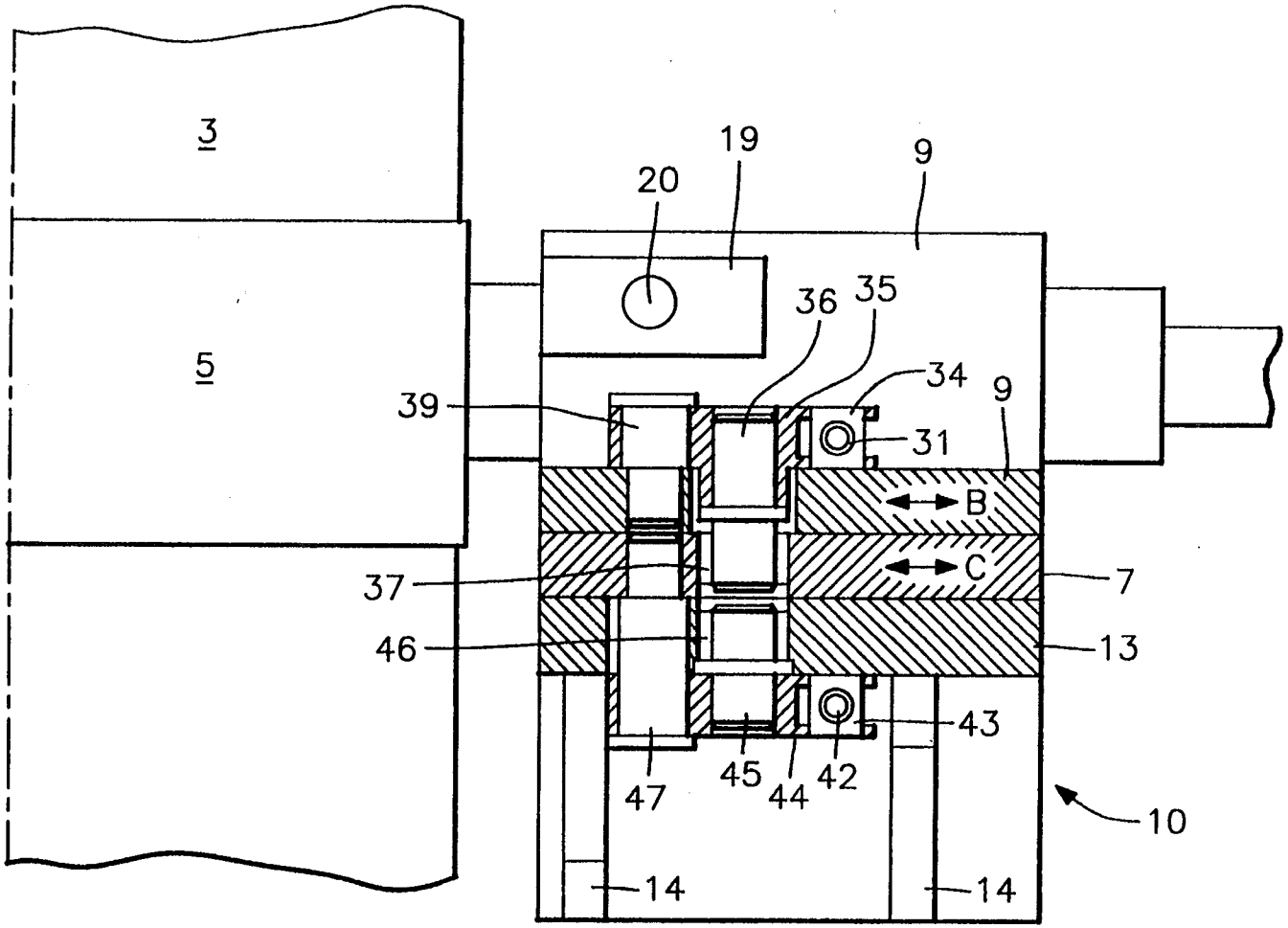
FIG. 4 is a sectional representation along line IV—IV of FIG. 3.
Figure 5:
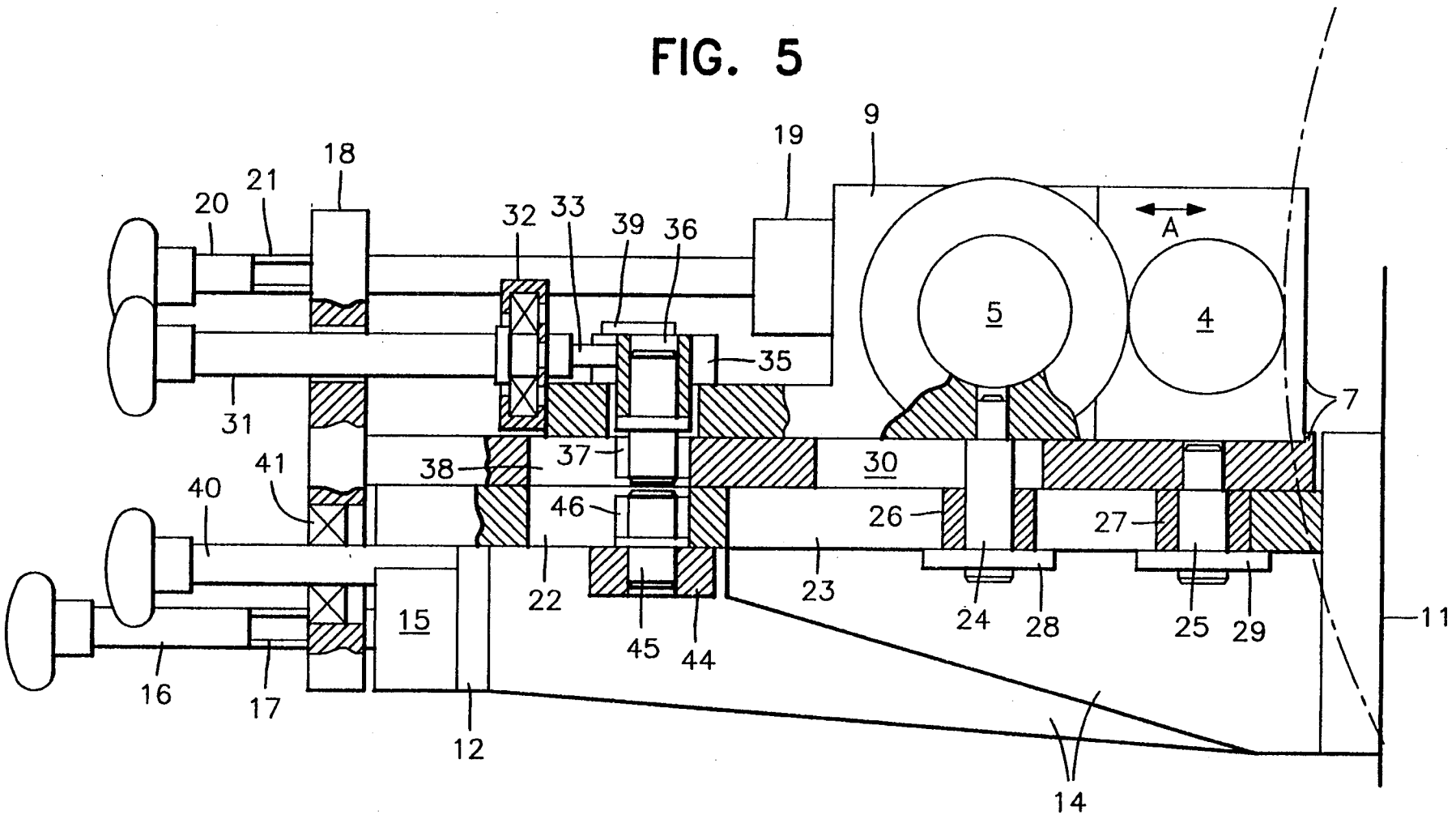
FIG. 5 is the side view of the part ringed in FIG. 1 with dashed lines in an enlarged representation and partly in section.

FIG. 1 shows that six inking units in all are positioned on a printing unit stand 1 of a flexographic printing press. As shown in this connection in FIG. 2, the plate cylinder 4 and the inking roller 5 face towards the impression cylinder 3, both the plate cylinder 4 and the inking roller 5 being mounted in a cantilever mode, that is to say, one-sidely. For this purpose, the journal pin 6 of the plate cylinder 4 is mounted in a plate cylinder block 7, while the journal pin 8 of the inking roller 5 is drivable mounted in the inking roller block 9. It may be seen in particular in FIG. 5, that the inking roller block 9 rests on the plate cylinder block 7, while the latter is supported by a bracket 10 (FIG. 4).

The bracket 10 consists in essence of a rear end plate 11, a front end plate 12, a bracket plate 13 and connecting plates 14. A bearing housing 15, which is for example firmly screwed onto the front end plate 12, includes a lead screw 16 mounted for rotation. This lead screw 16 has a threaded portion 17 which engages in a corresponding mating thread of a plate 18. This plate 18 is rigidly connected to the plate cylinder block 7 so that by rotating the lead screw 16, the plate cylinder block 7 can be moved to and fro in the direction of arrow A via the plate 18. Since the inking roller block 9 bears on the plate cylinder block 7, the inking roller is thereby also automatically adjusted.

However, as is common practice, the inking roller 5 can also be adjusted relative to the plate cylinder 4. For this purpose, provision is made on the inking roller block 9 for a bearing 19 wherein is rotatably mounted a lead screw spindle 20. This screw spindle has a threaded portion 21 wherein there engages a mating thread of the plate 18. Accordingly, by rotating the lead screw 20, the inking roller 5 can be displaced relative to the plate cylinder 4. This adjustment facility described above is common practice so that it need not be discussed further.

The actual problem of the printing press herein described with its cantilevered mounting of the plate cylinder and inking roller lies in trying to obtain a uniform contact pressure over the whole length of the plate cylinder, although the cylinder is only mounted at one end, and the same applies for the inking roller. Thus a precaution must be taken to allow the plate cylinder 4 and the inking roller 5 to be positioned over their length with a corresponding contact pressure as required against the impression cylinder 3. For this purpose, the bracket plate 13 has two longitudinal grooves 22 and 23. At the same time, sliding blocks 26 and 27 mounted on pins 24 and 25 are guided in the groove 23 and are secured by disks 28 and 29 against dropping out. The pin 25 is at the same time firmly screwed into the plate cylinder block 7 and the pin 24 is firmly screwed into the inking roller block 9. To allow the pin 24 to move in the plate cylinder block 7, the block 7 has a longitudinal groove 30. This mounting makes it possible for the plate cylinder block 7 to be pivoted together with the inking roller block 9 round the pin 25, whereas the inking roller block 9 can once more be pivoted separately round the pin 24, so that on the one hand, the contact pressure conditions of the inking roller 5 against the plate cylinder 4 can be set over the whole length, and on the other hand the contact pressure of the plate cylinder 4 against the impression cylinder 3 can be set.

Before the start of printing, the inking roller 5 is first inked up and is set against the plate cylinder 4 in such a way that the ink is uniformly transferred over the whole length onto the plate cylinder. For this purpose, provision is made for a lead screw 31 which is freely carried through the plate 18 and is mounted in a housing 32. This housing 32 is rigidly connected to the inking roller block 9. The end of the lead screw 31 emerging from the housing 32 on the side facing the inking roller engages with its threaded portion 33 in a nut 34 which is pivotally mounted in a lever 35. A guide pin 36 is moreover firmly screwed into the lever 35, which pin carries a sliding block 37 at its downwardly projecting end. The block 37 is guided in a groove 38 which is provided in the plate cylinder block 7. The lever 35 itself is pivotally mounted on a pivot pin 39 which is firmly screwed into the inking roller block 9. FIG. 4 shows that the lever 35 has an extension which projects with play into the inking roller block 9. Now if the lead screw 31 is rotated, the lever 35 pivots round the pivot pin 39, whereby the sliding block 37 is, on the one hand, slightly displaced in a straight line in the groove 38, but does not permit lateral movement; the constrained lateral movement which does nevertheless arise therewith is transmitted by the pivot pin 39 to the inking roller block 9, so that the latter is slightly pivoted round the pin 24. Since, however, the guide pin 36 is also subjected to a lateral displacement during this movement, the latter is designed to project with play into the inking roller block 9, as has already been described above. This wider shape of the lever 35 in the zone of the guide pin 36 only serves the purpose of stabilization. The lateral pivoting movement of the inking roller block 9 relative to the plate cylinder block 7 is indicated by arrow B in FIGS. 2 and 4.

After the inking roller 5 has thus been set against the plate cylinder 4 in such a way that ink is being uniformly transferred to the plate cylinder, the plate cylinder 4 too must be appropriately set against the impression cylinder 3. This is done as has been usual hitherto, first of all in that both the inking roller 5 and the plate cylinder 4 are moved towards the impression cylinder 3 by means of the screw spindle 16. Now if it is found that because of the one-sided mounting, no uniform contact pressure is produced, the plate cylinder 4 must be pivoted. This is done by rotating the lead screw 40 which is mounted by means of a roller bearing 42 in the plate 18 of the plate cylinder block 7. Like the lead screw 31, it has a threaded portion 42 which engages in a nut 43. Just like the nut 34, the nut 43 is also mounted in a lever 44 into which a pin 45 is additionally firmly screwed. This pin 45 carries at its end projecting upwards from the lever 44 a sliding block 46 which is guided in the longitudinal groove 22 of the bracket plate 13. The lever 44 itself is pivotally mounted on a pivot pin 47 which is carried upwards with play through the bracket plate 13 and is firmly screwed into the plate cylinder block 7. By rotating the lead screw 40, the lever 44 is pivoted round the pivot pin 47 whereby the sliding block 46 is slightly displaced in the groove 22. The lateral movement occurring simultaneously therewith is transferred by the pivot pin 47 to the plate cylinder block 7, since the pivot pin 47 is firmly screwed into the plate cylinder block 7 and it is only the block 7 that is movable, whereas on the contrary, the bracket plate constitutes a fixed part. Since during the pivoting of the lever 44, the pivot pin 41 is also subjected to a slight lateral displacement movement, the pin 47 is carried with play through the bracket plate 13 as has already been mentioned above. Accordingly, the plate cylinder block is pivoted round the pin 25. This pivoting movement is indicated by arrow C in FIGS. 2 and 4.

Figure 6:
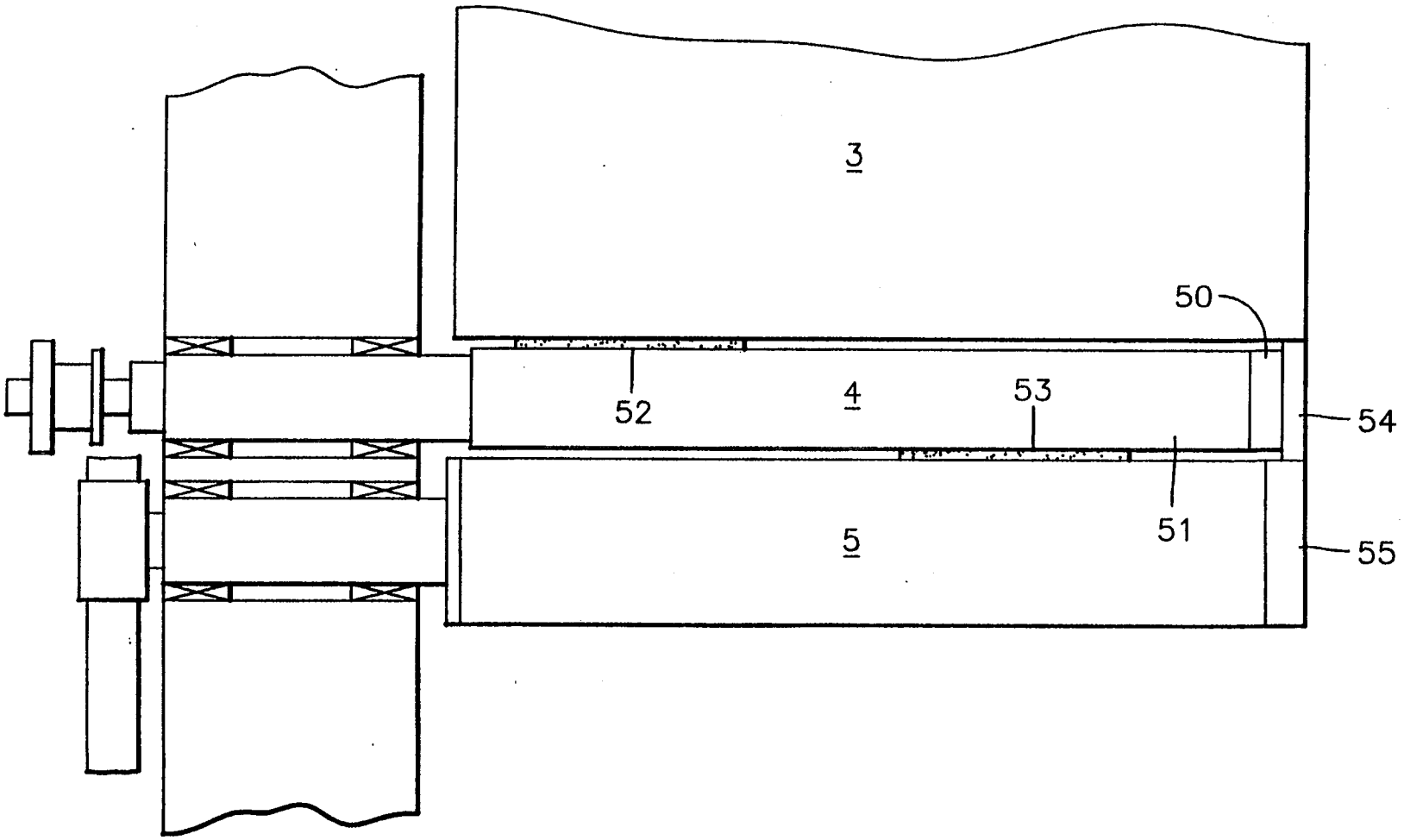
FIG. 6 is a side view of the cantilever type mountings of the plate cylinder and of the inking roller corresponding to FIGS. 2 and 3.

As shown in FIG. 6, a plate cylinder sleeve 51 is fitted and secured on the core 50 of the plate cylinder 4; this sleeve 51 carries schematically indicated stereotypes (masters) 52, 53. A ring 54 made of an elastomeric material is secured on the free end of the core of the plate cylinder 4 which runs on the impression cylinder 3 and on an unlinked end section 55 of the inking roller 5. The diameter of the ring 55 corresponds to the diameter of the circular envelope described by the stereotypes (masters) 52, 53.

We claim:

1. An inking unit comprising:

an inking roller, a plate cylinder, a bracket plate, a plate cylinder block displaceable on said bracket plate, one end of said plate cylinder being cantileverly mounted on said plate cylinder block, a plate rigidly connected to said plate cylinder block and extending perpendicular to said plate cylinder block, a bearing housing connected to said bracket plate, a lead screw rotatably mounted in said bearing housing for displacing said plate cylinder for horizontal displacement of said plate cylinder in a direction towards and in a direction away from said inking roller, a lever having two ends, a second lead screw engaging one end of said lever, the other end of said lever being pivotally mounted in said plate cylinder block and including in a central zone, a pin projecting into a longitudinal groove of said bracket plate for pivotally moving said plate cylinder with respect to said ink roller.

2. An inking unit according to clam 1, wherein said inking roller is mounted at one end on an inking roller block, said inking roller block being displaceably mounted on said plate of said plate cylinder block.

3. An inking unit according to claim 2, wherein a third lead screw threadedly engaging said plate is rotatably mounted in a bearing rigidly connected to said inking roller block for displacing the inking roller.

4. An inking unit according to claim 1, wherein said inking roller block is pivotally mounted for displacement by a third lead screw, and wherein said third lead screw engages one end of a lever having two ends whose other end is pivotally mounted in said inking roller block, and including in a central zone, a guide pin projecting into a groove in said plate cylinder block.

5. An inking unit according to claim 1, including a ring fitted on a free end of said plate cylinder,a diameter of said ring corresponding to a diameter of a cylindrical envelope located on said plate cylinder.

6. An inking unit according to claim 5, wherein said ring consists of an elastomeric material.

7. An inking unit comprising:

an inking roller, a plate cylinder, a plate cylinder block, one end of said plate cylinder being cantileverly mounted on said plate cylinder block, a plate rigidly connected to said plate cylinder block and extending perpendicular to said plate cylinder block, an inking roller block, one end of said inking roller being cantileverly mounted on said inking roller block, a lever having two ends, and a lead screw extending through said plate and engaging one end of said lever, the other end of said lever being pivotally mounted on said inking roller block, said lever including a guide pin projecting into a groove of said plate cylinder block for pivotal movement of said inking roller with respect to said plate cylinder upon rotation of said lead screw.

8. An inking unit comprising:

an inking roller, a plate cylinder, a bracket plate, a plate cylinder block displaceable on said bracket plate, one end of said plate cylinder being cantileverly mounted on said plate cylinder block, a plate rigidly connected to said plate cylinder block and extending perpendicular to said plate cylinder block, an inking roller block, one end of said inking roller being cantileverly mounted on said inking cylinder block, and means engaging said plate cylinder block and said inking roller block for horizontally moving said plate cylinder and said inking roller towards and away from each other and for horizontally moving said plate cylinder and said inking roller together, and said engaging means including two levers each having two ends, one of said two levers having a pin projecting into a longitudinal groove of said bracket plate, the other of said two levers having a pin projecting into a groove of said plate cylinder block, one end of each of said two levers engaging a separate one of two rotation means and the other end of said two levers being pivotally mounted for selective pivotal movement of said inking roller and said plate cylinder upon selective rotation of said two rotation means.

* * * * *